United States Patent [19]

Galan

[11] 4,216,752

[45] Aug. 12, 1980

[54] SPILL VALVE FOR A FLUID CONTROL SYSTEM

[75] Inventor: Louis Galán, Ann Arbor, Mich.

[73] Assignee: The Bendix Corporation, Southfield, Mich.

[21] Appl. No.: 920,926

[22] Filed: Jun. 30, 1978

[51] Int. Cl.[2] ..... F02M 39/00

[52] U.S. Cl. ..... 123/499; 123/506; 137/883

[58] Field of Search ..... 123/139 AF, 139 AP, 123/139 AQ, 139 AL, 139 AZ, 139 BC, 139 E, 32 AE, 139 AT; 137/883

[56] References Cited

U.S. PATENT DOCUMENTS

| | | | |
|---|---|---|---|
| 135,220 | 1/1873 | Harang | 137/883 |
| 2,852,308 | 9/1958 | Whitson | 123/32 AE |
| 3,719,435 | 3/1973 | Eheim | 123/139 E |
| 3,851,635 | 12/1974 | Murtin et al. | 123/139 E |
| 3,859,972 | 1/1975 | Watson et al. | 123/139 AR |
| 3,880,130 | 4/1975 | Hecht | 123/119 B |

*Primary Examiner*—Ira S. Lazarus
*Assistant Examiner*—Magdalen Moy
*Attorney, Agent, or Firm*—Markell Seitzman; Russel C. Wells

[57] ABSTRACT

A spill valve (40) for use in a fluid control system (10), such as an automotive fuel injection system, where the mass flux of a pressurized fluid through a line (26) is to be controlled in either time or quantity or both. The spill valve (40) is connected between a fluid chamber (18) containing pressurized fluid and drain. When the spill valve (40) is open, the pressurized fluid in the chamber (18) is vented to drain; and when closed, the fluid is permitted to flow normally. The present spill valve (40) includes a valve body (100, 102, 104) having spill inlet and outlet ports (130, 132). A spill conduit (70) is disposed in the valve body and has first and second parallel spill paths therethrough to communicate the spill inlet and outlet ports (130, 132). An elongate valve closure element (50) is disposed within the spill conduit (70) to control the opening and closing of the first and second spill paths. The valve closure element (50) is actuated at either of its ends (54, 56) by a pair of rotary solenoid relays (80). The elongate valve closure element (50) has a central spindle section (52) that can undergo torsion to allow either of the pair of rotary solenoid relays (80) to act independently in closing off the first or second spill paths. The torsion in the central spindle section (52) stores potential energy that accelerates the transition of the valve from a closed state to an open state.

26 Claims, 11 Drawing Figures

SPILL VALVE FOR A FLUID CONTROL SYSTEM

TECHNICAL FIELD

This invention relates to a spill valve for use in a fluid control system, and has particular application in controlling the injection and metering of fuel in an automotive fuel injection system.

BACKGROUND ART

In a conventional form of fuel injection system, fuel is injected into an engine cylinder through a fuel injector mounted on the cylinder head. One known form of a fuel injector is a needle-lift injector which responds to a pulse or charge of pressurized fuel by opening and permitting the pressurized fuel to be injected into the cylinder through the duration of the pulse. In a compression ignition (diesel) engine, the timing of the pulse and its duration must be carefully controlled to correlate injection timing and fuel quantity with the actual and commanded speeds of the engine at a given set of engine operating conditions.

One known method for controlling injection timing and fuel quantity or metering is to spill back to drain some of the fuel produced through the power stroke of each cycle of a high-pressure fuel injection pump. More specifically, by using only a preselected interval within the power or work stroke of the pump, a pressure pulse having appropriate timing and duration in relation to engine crankshaft position and actual and commanded engine speeds can be produced. Although this principle of spilling fuel back to drain may intuitively seem wasteful, it has proven to be highly effective, especially for fuel injection systems with piston-type pumps that are synchronized with the engine crankshaft. The power stroke of a high pressure piston pump is generally long enough to permit the advance or retard of injection and to accommodate the desired range of fuel metering. The remaining portion of the power stroke is not used to provide fuel to the cylinders, and the pressurized fuel produced by the pump during this portion can be relieved or spilled back to drain through a spill valve connected to the fuel pump. The spill valve is normally connected in a spill path between the pump chamber and drain.

The actuation of the spill valve determines which preselected portion of the power stroke will be used for fuel injection. During the preselected portion of the power stroke that is to be used for fuel injection, the spill valve is closed and the spill path communicating the pump chamber and drain is interrupted. However, during the remaining portion of the power stroke that is not used for fuel injection, the spill valve is opened and the spill valve communicates the pump chamber to drain.

It is important that the actuation of the spill valve between its closed and open conditions be relatively fast so that the timing of injection and metering of fuel can be closely controlled. A conventional method of actuating a spill valve between its closed and open conditions is to appropriately energize or deenergize a solenoid relay in the spill valve that controls the opening and closing of a spill path through the valve. There are, however, certain limitations associated with a conventional solenoid relay in this application. Specifically, a conventional solenoid relay has a response time limited by the time required for the buildup of a magnetic field and the dissipation of residual magnetism. In addition, inertial effects can also delay the response time of a conventional solenoid relay.

An example of a prior art device employing a solenoid relay is the distributor-type fuel injection system disclosed in Twaddell et al, U.S. Pat. No. 3,880,130, issued Apr. 29, 1975. The Twaddell et al device employs two complementary solenoid relays that cooperate to open and close a spill line connected to the chamber of a distributor pump. Each solenoid relay functions independently of the other solenoid relay and has a response time determined by its separate characteristics. Also of interest are the teachings contained in the patents to Eheim, U.S. Pat. No. 3,841,286; Watson et al, U.S. Pat. No. 3,859,972; and Murtin et al U.S. Pat. No. 3,851,635.

Where response time limitations are present, they are multiplied in effect when a single spill valve unit is used to control the fuel injection and metering of a plurality of cylinders. More particularly, in a distributor-type injection system, where a pump is connected to a parallel injector network and the spill valve is connected to the pump upstream of the injector network, the spill valve must go through a complete spill cycle for each cylinder fed by the injector network. Stated otherwise, for a four-cylinder, four-cycle engine, the spill valve must complete two spill cycles through each revolution of the engine crankshaft. At relatively high engine speeds, e.g. 6,000 RPM, the spill valve must have relatively fast actuation and deactuation times to maintain precision control over injection time and fuel metering for each cylinder. This requirement poses a severe timing requirement for spill valves using conventional actuation devices.

An objective, therefore, of the present invention is to provide a spill valve with a relatively fast response time that can be used as a single point control in a fuel injection system to precisely control the injection and metering of fuel through a high range of engine speeds.

DISCLOSURE OF THE INVENTION

The present invention is a spill valve (40) for use in an engine fuel injection system (10). The spill valve (40) has a relatively fast response time that allows it to be used for single point control in a distributor-type fuel injection system.

Broadly, the fast response time of the valve is achieved by employing a valve closure element (50) that stores potential energy during a transition from an open condition to a closed condition, and then releases the potential energy when it undergoes a converse transition from a closed to an open condition. The release of the potential energy accelerates the transition from the closed condition to the open condition to provide a sharp cut off of injection. Moreover, the build up of potential energy against the reactive force of the closure element provides a relatively smooth start of injection. In more specific terms, it is desirable for purposes of fuel combustion within the cylinder to have a gradual slope at the leading edge of the pressurized fuel charge, and this is accomplished by the present invention.

In the embodiment to be hereinafter disclosed, the spill valve (40) includes a valve body (100, 102, 104) having a spill inlet port (132) adapted to communicate with the chamber (18) of a piston pump (12), and a spill outlet port (130) that communicates with a fuel drain. A spill conduit, preferably in the form of a hollow, cylindrical sleeve (70), is disposed within the valve body (100, 102, 104). The spill conduit (70) has an inlet opening (72) that communicates with the spill inlet port (132); a first outlet opening (74) that communicates with the spill outlet port (130) to define a first spill path; and a second outlet opening (76) that communicates with the spill outlet port (130) to define a second, parallel spill path. A valve closure element (50) is disposed within the spill conduit (70) and controls the opening and closing of the first and second spill paths. The valve closure element (50) preferably has a spindle-like shape (52) and is rotatable within the spill conduit (70) about its longitudinal axis. In a first, unstressed position, the valve closure element (50) closes the first spill path and leaves open the second spill path to allow spilling; in a second, stressed position, the closure element (50) closes both the first and second spill paths to allow fuel injection; and in a third, unstressed position, the closure element (50) opens the first spill path and closes the second spill path to allow spilling. In short, the valve closure element (50) has two basic conditions, stressed and unstressed. In its unstressed condition, spilling occurs, and in its stressed condition, fuel injection to the cylinders occurs. The transition of the valve closure element (50) from its unstressed condition to its stressed condition is accompanied by a build up of potential energy in moving the closure element between its first and second positions. This provides a relatively gradual onset of injection as is desirable. The transition of the valve closure element (50) from its stressed condition to its unstressed condition is accompanied by a release of the potential energy stored by the closure element. This accelerates its actuation between its second and third positions and marks a rapid cutoff of injection.

The valve closure element (50) is actuated by a pair of rotary solenoid relays (80). In preferred form, one rotary solenoid relay (80) is coupled to each of the opposite ends (54,56) of the elongate valve closure element (50). The selective energization of the rotary solenoid relays (80) controls the position and the potential energy condition of the valve closure element (50). In another feature of the invention, each of the solenoid relays includes a pair of damping coils (94,96) to control the deceleration characteristics of the solenoid armature (84).

Other advantages of the present invention will be readily appreciated as the same becomes better understood by reference to the following detailed description when considered in connection with the accompanying drawings.

BEST MODE FOR CARRYING OUT THE INVENTION

Figure 1:
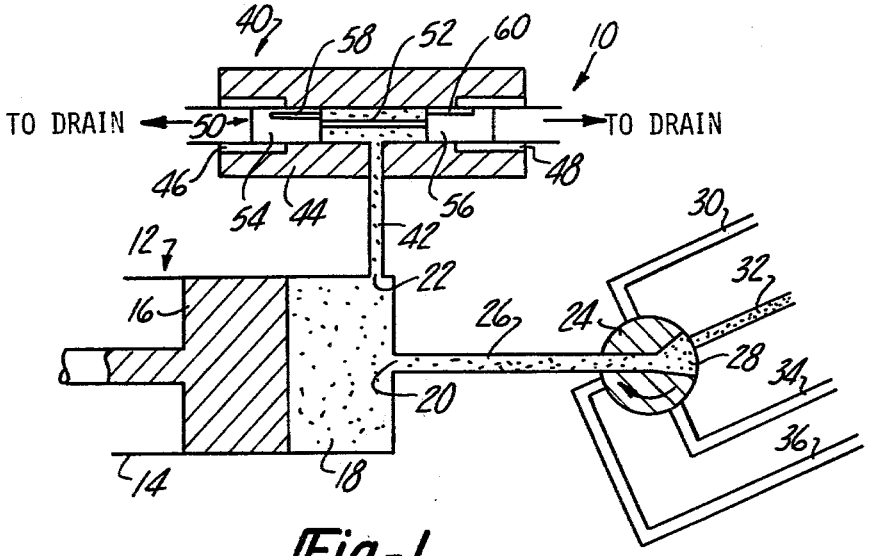
FIG. 1 is a schematic illustration of a distributor pump fuel injection system.

A distributor pump fuel injection system of the type for which the present invention is adapted is shown generally at 10 in FIG. 1. This type of fuel injection system has particular uility in a compression ignition engine, i.e. diesel engine, where injection timing and fuel quantity requirements are most critical for proper engine performance.

The distributor pump fuel injection system 10 includes a piston pump 12. The pump 12 comprises a cylinder 14 having disposed within it a reciprocating piston 16. The internal volume of the cylinder 14 that at any given instant is not taken up by the piston 16 defines a fuel chamber 18. When the piston 16 is on its return stroke, the volume of the chamber 18 increases and its pressure correspondingly decreases to allow fuel to be drawn into the chamber 18 from a source (not shown). When the piston 16 is on its power or work stroke, the volume of the chamber 18 decreases and its pressure correspondingly increases to pressurize the fluid for delivery through an outlet port 20. The pump chamber 18 also includes a spill port 22 which, as will hereinafter be described more fully, communicates the pump chamber 18 to drain during preselected portions of the power stroke of the piston to control injection timing and fuel metering.

A distributor 24 is in communication with the pump outlet port 20 through a fuel line 26. The function of the distributor 24 is to apportion fuel to the engine cylinders in timed relation to their firing order. The distributor 24 includes a rotating orifice 28 whose angular velocity is timed with the engine crankshaft to deliver fuel to a plurality of injector feed lines 30, 32, 34 and 36 in the order in which the fuel is required.

A spill valve, generally indicated at 40, is in communication with the spill output port 22 in the pump chamber 18 through a spill line 42. The function of the spill valve 42 is to spill or vent the pump chamber 18 to drain (normally the fuel tank or other low pressure region) at all times except for a preselected time interval of the power stroke from the piston 16. The spill valve 40 provides a means for controlling the flux of the fuel through the line 26, both in timing and quantity. During the preselected time interval when the pump chamber 18 is not spilled to drain, the pump will output a pressurized charge of fuel through the line 26 to the distributor 24. The distributor 24 will distribute the fuel to the injector feed line with which it is presently communicating. The timing of injection and metering of fuel can thereby be controlled by the opening and closing of the spill valve 40.

The spill valve 40, in schematic form, includes a valve body 44. The valve body 44 has a pair of opposed end ports 46 and 48, each of which is in communication with drain. The valve body 44 has a central longitudinal opening in which is disposed a valve closure element, generally indicated at 50. The valve closure element 50 includes a central spindle or rod 52. At each end of the rod 52 is affixed a rotatable head 54 and 56. In the head 54 are formed a pair of slits 58 or a series of circular orifices that provide fuel passages between the end port 46 and the spill line 42 when the slits or orifices 58 are in registry with the end port. Otherwise, the head 54 interrupts communication between the end ports 46 and the spill line 42 and closes off the fuel passage. Similarly, the opposite head 56 has a pair of slits 60 or a series of circular orifices that function as fuel passages when in registry with the end port 48. In the particular illustration of FIG. 1, the slits 60 are in registry with the end ports 48 and fuel from the pump chamber 18 will be permitted to be spilled to drain through the spill line 42 out the end port 48. When the slits 60 of the head 56 are not in registry with the end port 48, the fuel passages to drain are closed.

The spill valve 40 can be used to control injection timing and fuel metering by controlling the angular position of each of the heads 54 and 56 of the valve closure element 50. With either of the end ports 46 and 48 in communication with respective slits or apertures 58 and 60, the spill valve 40 will be opened and permit spilling of the pump chamber 18 to drain. With neither of the end ports 46 and 48 in communication with respective slits or apertures 58 and 60, the spill valve will be closed and permit fuel to be output from the pump chamber 18 to the distributor 24 by the line 26. In order to allow the angular position of each of the heads 54 and 56 to be independently controllable, the spindle or rod 52 is formed of elastically deformable material, such as stainless steel, with a sufficiently small diameter to allow it to readily undergo torsion under the influence of a rotary solenoid relay or similar type actuating means. In this manner, each of the heads 54 and 56 can be actuated and released independently of the other. This feature is used to an advantage to achieve fast actuation and release in the operation of the spill valve to provide precise control over injection timing and fuel metering.

Figure 2:
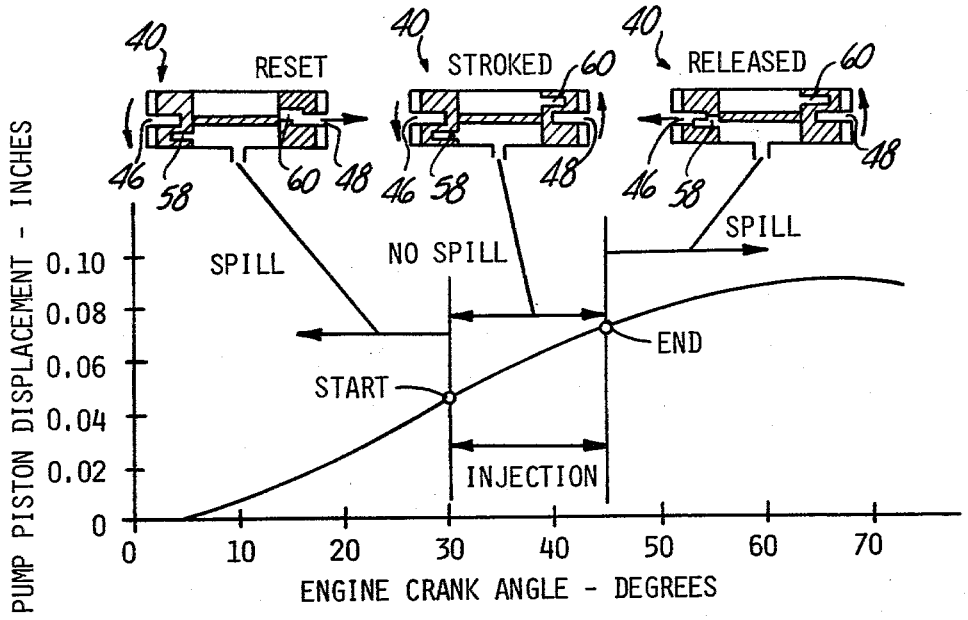
FIG. 2 is a graph of engine crank angle versus pump piston displacement in the fuel injection system of FIG. 1, that correlates the three basic positions of a spill valve of the present invention with actual fuel injection.

Reference is now made to FIG. 2, which correlates the three basic positions of the spill valve 40 with timing of injection and metering of fuel.

First referring to the schematic view of the spill valve 40 under the heading RESET, the valve is in open condition and spilling fuel to drain. Specifically, a torque as indicated by the arrow at the left of the valve 40, is applied to the left head (54 in FIG. 1) to take the aperture 58 out of registry with the end port 46, and bring the aperture 60 into registry with the end port 48. In this position, which is hereinafter referred to as the reset position, the valve 40 is open and spilling occurs through the end port 48.

In the schematic view of the spill valve 40 under the heading STROKED, the valve is closed and fuel injection takes place. Specifically, the torque applied to the left head (54 in FIG. 1) is held and a counter-torque, as indicated by the arrow to the right of the spill valve 40, is applied to the right head (56 in FIG. 1). The initial torque applied to the left head maintains the nonregistry of the aperture 58 with the end port 46, and the counter-torque applied to the right head takes out of registry the aperture 60 with the end port 48. In this position, as will hereinafter be referred to as the stroked position, the valve 40 is closed and injection to the engine cylinders can take place.

In the schematic view of the spill valve 40 under the heading RELEASED, the valve is open and spilling occurs through end port 46. Specifically, the torque applied to the left head (54 in FIG. 1) is released and the counter-torque applied to the right head (56 in FIG. 1) is maintained. This release of torque to the left head maintains the nonregistry of of the aperture 60 with the end port 48, and brings into registry the aperture 58 with the end port 46. In this position, as will hereinafter be referred to as the released position, the valve is open and spilling occurs.

The graph of FIG. 2 relates engine crank angle (in degrees) with piston pump displacement (in inches), and moreover, correlates the three basic positions of the spill valve 40 with these parameters. The useful interval during which it is practical to inject fuel into the cylinders is approximately 40 crank degrees. During the rest of the pump piston power stroke, i.e. 10 crank degrees before and 10 crank degrees after the useful 40-degree interval, the piston velocity is too low to sustain a desirable injection rate. Therefore, in the exemplary case of FIG. 2, the spill valve 40 is in the reset position for the first 30 degrees crank angle displacement. During the interval from 30 to 45 degrees crank angle displacement, (the exact number of degrees depending upon fuel metering requirements) the valve 40 is in the stroked position to allow fuel injection to take place. From 45 degrees to end of the piston power stroke, the valve 40 is in the released position to spill fuel to drain.

It can be appreciated from the foregoing description that the spill valve 40 has two distinct energy conditions that it passes through as it completes each injection cycle. More specifically, when the spill valve 40 is in the reset position, it is in an unstressed or low energy condition, i.e. there is no torsion in the spindle 52 of FIG. 1. When injection begins and the spill valve 40 goes from the reset to the stroked position, it is in a stressed or high energy condition due to the torsion in the spindle 52, caused by the mutually opposite torques applied to the end heads 54 and 56. In particular, there is a build-up of torsion in the central spindle 52 which in effect causes the spindle to "wind up" in the manner of a torsion spring. This winding up gives a desirable relatively-gradual slope to the leading edge of a pressurized fuel pulse to facilitate its combustion in the cylinder. At the end of injection when the spill valve 40 goes from the stroked position to the released position, it experiences a transition to an unstressed or low energy condition. More particularly, the opposing torque applied to one head of the valve closure member 50 of FIG. 1 is released and the torsion in the spindle 52 is likewise released. The release of energy stored in the spindle 52 accelerates the transition of the spill valve 40 from the stroked position to the released position and concomitantly provides a rapid cutoff of fuel injection.

Figure 3:
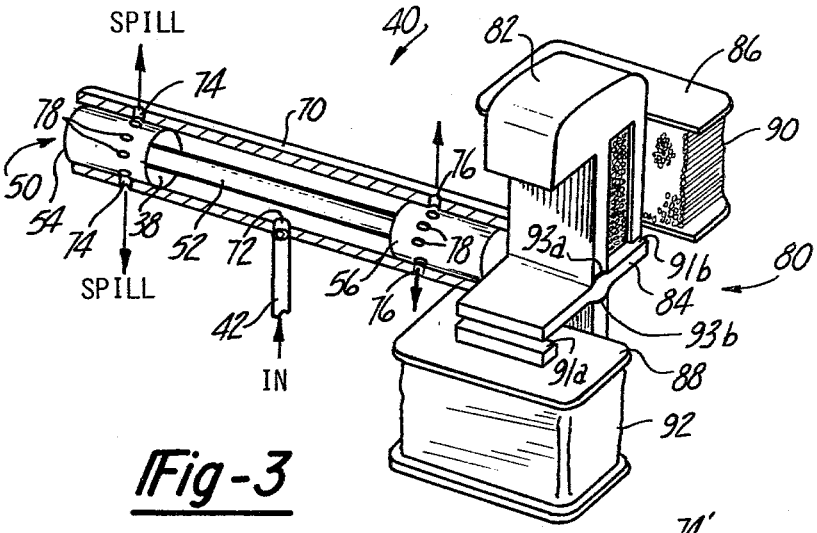
FIG. 3 is a diagrammatic view of a generalized form of spill valve in accordance with the present invention.

Reference is now made to FIG. 3 which is a diagrammatic view of a generalized spill valve 40 incorporating the present invention. The spill valve 40 is shown in pertinent cross-sectional part to provide a background for understanding the principles of operation of an actual embodiment illustrated in FIGS. 4, 5, 6 and 7.

The spill valve 40 includes a hollow cylindrical sleeve 70. The sleeve 70 has a spill inlet port 72 formed centrally in its bottom surface to receive fuel through a spill line 42. A set of spill outlet ports 74 are formed circumferentially at one end of the sleeve 70, and another set of spill outlet ports 76 are formed circumferentially in the other end of the sleeve. The spill outlet ports 74 and 76 are in communication with drain.

A valve closure element, generally indicated at 50, is disposed within the cylindrical sleeve 70 for rotational movement about the longitudinal axis of the sleeve. The valve closure element 50 includes a central section in the form of a spindle 52. The spindle has affixed to its opposed ends a pair of heads 54 and 56 that are dimensioned to be closely received within the sleeve 70. Each of the heads 54 and 56 has an open interior face 38 to allow the spindle 52 to be secured within the head. The securement of the spindle 52 within each of the heads 52 and 54 is by a rigid form of mechanical coupling, such as by pinning, welding or brazing.

The heads 54 and 56 each have a circumferential track of apertures 78. The apertures 78 have equal longitudinal spacing with the spill outlet ports 74 and 76. By rotating the head 54 through a predetermined angular displacement, the apertures 78 can be made to register or nonregister with the spill outlet port 74. When the apertures 78 and spill outlet port 74 are in registry, the valve is open and will spill fuel to drain, i.e. fuel entering the spill inlet port through line 42 can pass through the apertures 78 and out spill outlet port 74. Similarly, the apertures 78 in the head 56 can be brought into registry or nonregistry with the spill outlet port 76. When the apertures 78 are in registry with the spill outlet port 76, the valve 40 is open and spilling will occur. When the apertures 78 and the spill outlets 74 and 76 are in nonregistry, the valve is closed and spilling is interrupted. The position of each of the heads 54 and 56 can be independently controlled if the spindle 52 is formed of elastically deformable material with sufficient resilience or spring characteristic to permit it to undergo torsion by the influence of an electro-magnet or similar type actuating device through a range of angular displacement corresponding to the angular displacement required to bring the apertures 78 into and out of registry with the ports 74 and 76.

A rotary solenoid relay, generally indicated at 80, is used to control the position of the head 56 of the valve closure element 50. In an actual embodiment, a complementary rotary solenoid relay, like the relay 80, would be disposed at the opposed end of the sleeve 70 to control the positioning of the head 54. A complementary rotary solenoid relay is not shown in this view for clarity of illustration and ease of explantion.

The rotary solenoid relay 80 is mechanically coupled by means (not shown in the present view) to the head 56 of the valve closure element 50. The head 56 is rotatable by actuating a rotatable armature 84 forming part of the rotary solenoid relay. The rotatable armature 84 is centrally disposed in a stator assembly 82 and permitted a limited range of angular displacement. The stator assembly 82 supports a pair of bobbins 86 and 88. On the bobbin 86 is wound a solenoid coil 90, and on the bobbin 88 is wound a complementary solenoid coil 92. A magnetic flux path is formed through the stator assembly 82, the rotatable armature 84 and the air gaps 91*a* and *b* and 93*a* and *b* between the armature 84 and stator assembly 82.

By energizing the solenoid coils 90 and 92, the rotatable armature 84 will be caused to rotate through the angular displacement defined by the air gaps 91. The rotation of the armature 84 will transmit torque to the head 56 of the valve closure element 50 to change the relative position of the aperture 78 and the spill outlet ports 76.

Figure 4:
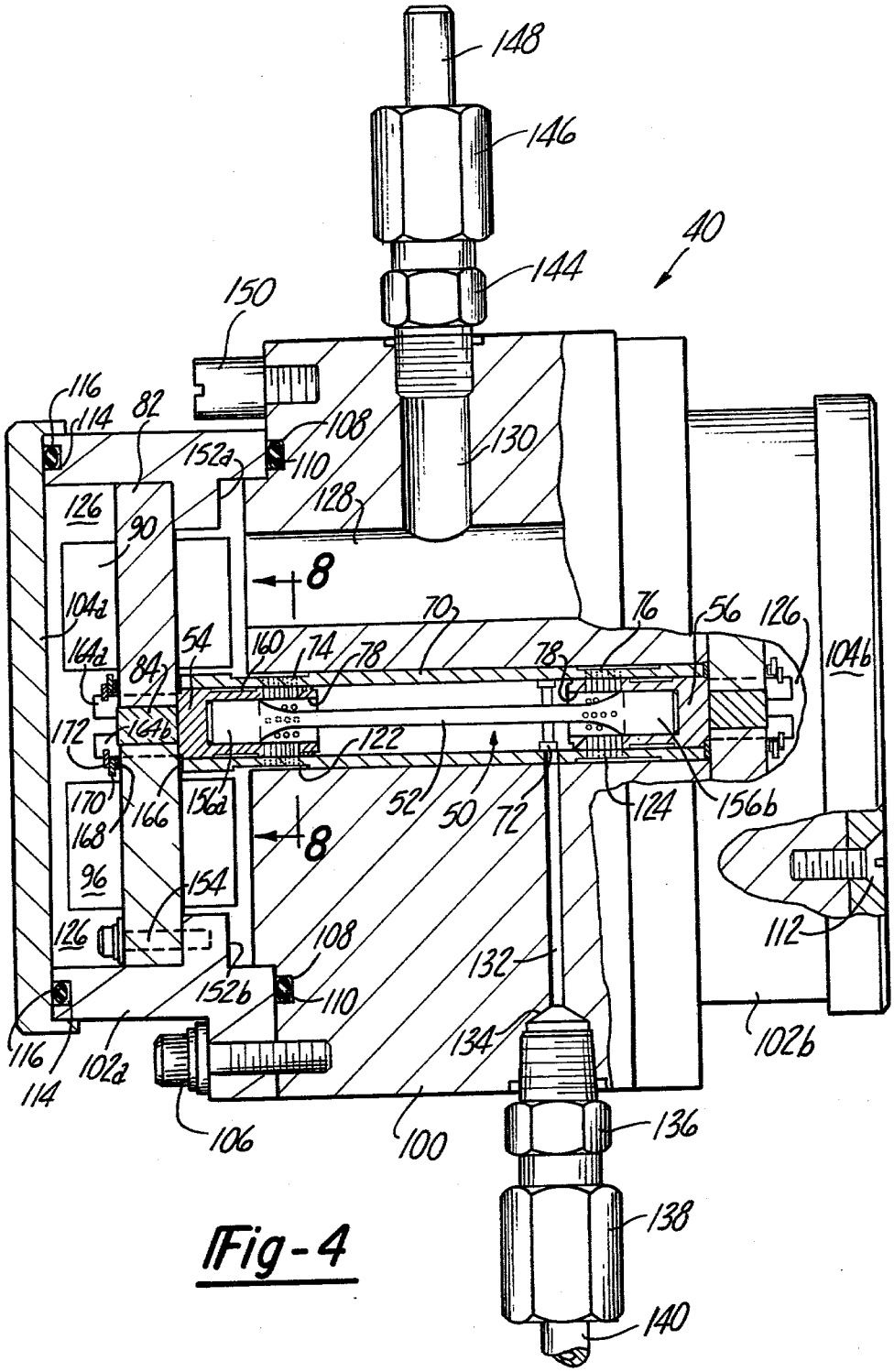
FIG. 4 is a side elevation view, taken in partial section, of an actual embodiment of a spill valve incorporating the present invention.
Figure 5:
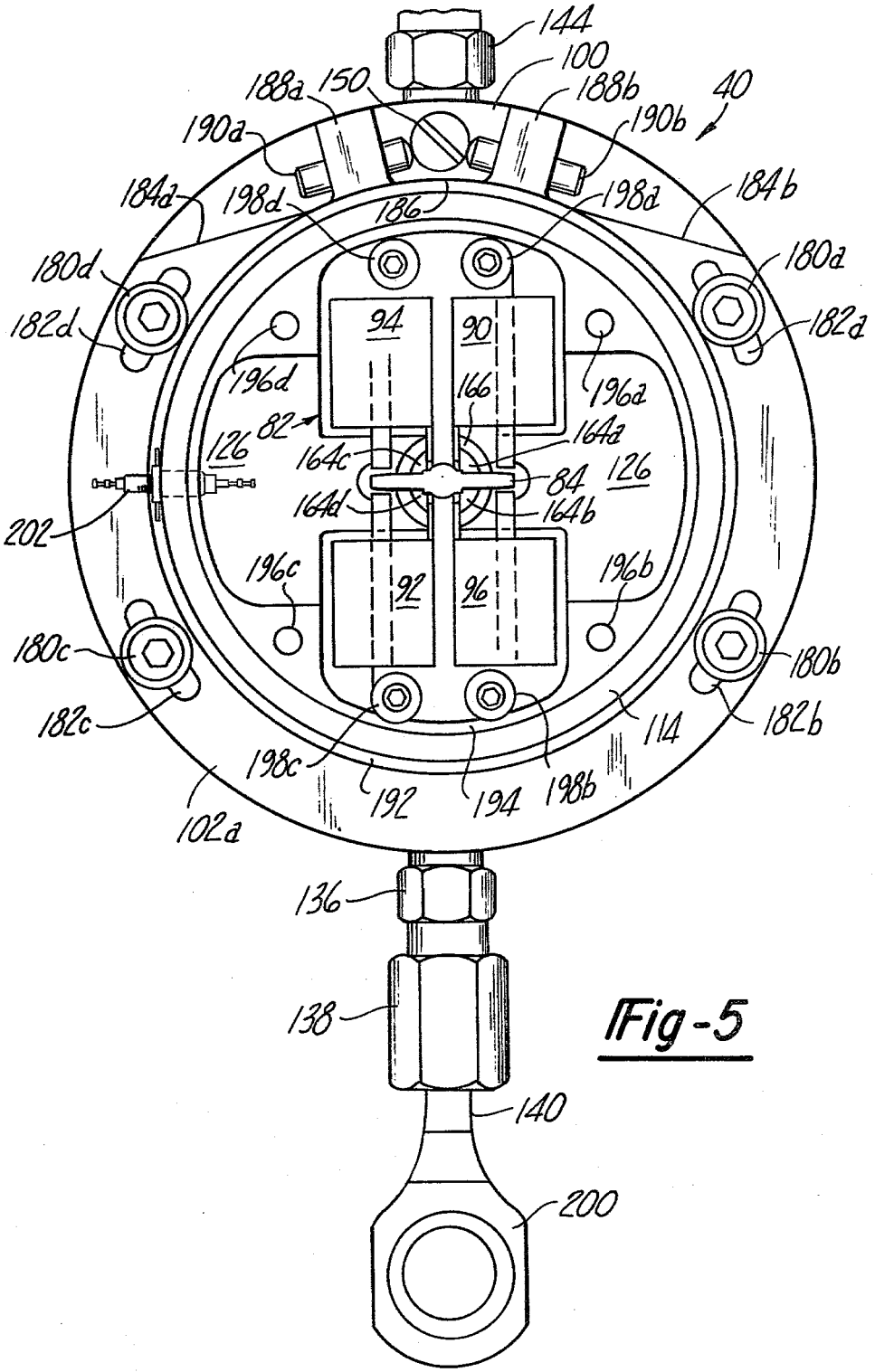
FIG. 5 is an end elevation view of the spill valve of FIG. 4.
Figure 7:
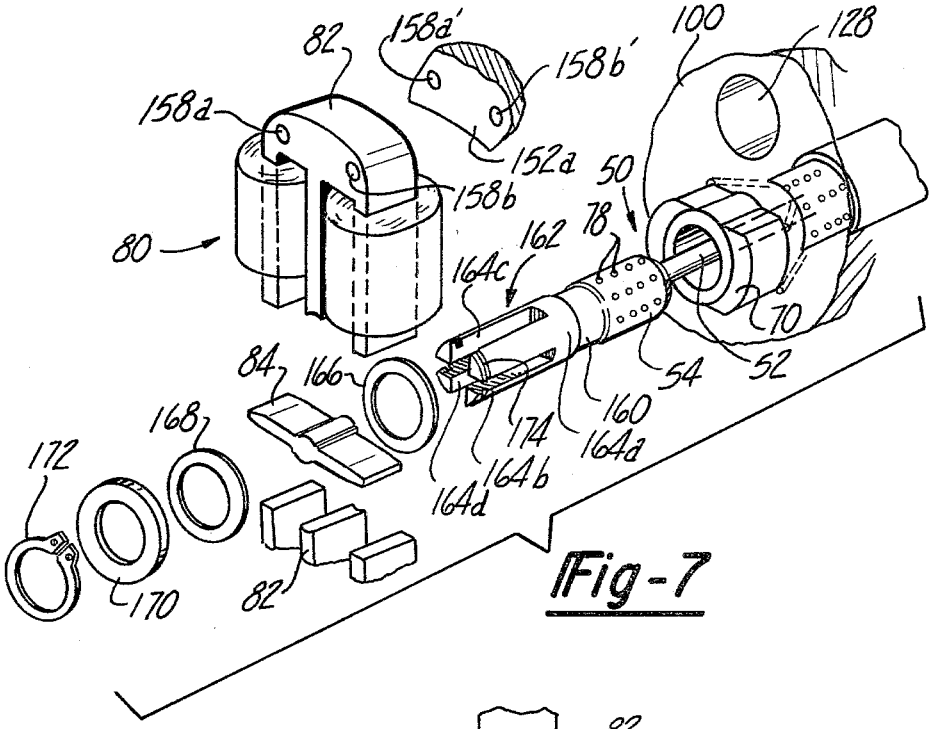
FIG. 7 is an exploded perspective view of the assembly of a valve closure element and rotary solenoid relay shown in FIGS. 4 and 5.
Figure 6:
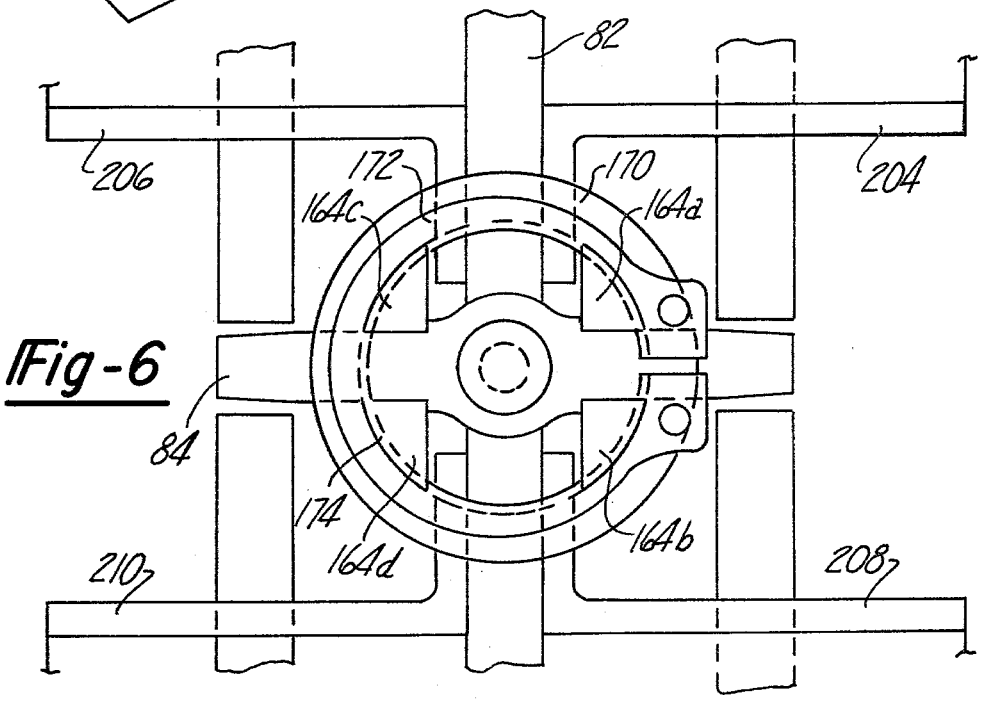
FIG. 6 is an enlarged representation of a portion of the end elevation view of FIG. 5.

Reference is now made to FIG. 4, which is in conjunction with FIGS. 5, 6 and 7 and illustrates an actual embodiment of a spill valve 40 embodying the present invention.

The spill valve 40 is constructed within a housing defined by a central body 100, a pair of end bells 102*a* and *b* coupled to the opposite faces of the central body, and a pair of covers 104*a* and *b* coupled to respective end bells. The spill valve 40 is symmetrical in construction about the central body 100, and where reference is made to the details of one end bell 102*a* and *b* or cover 104*a* or *b*, such reference is equally applicable to the other end bell or cover.

The end bell 102*a* is secured at its lower extreme to the central body 100 by fastening means such as a bolt 106. The central body 100 has a circumferential track 108 formed in the portion of its exterior surface that mates with the end bell 102*a*. An O-ring 110 is laid in the track 108 to provide a fluid seal between the central body 100 and the end bell 102*a*. The end cover 104*b* is secured to the end bell 102*b* by suitable fastening means, such as a machine screw 112. The end bell 102*a* has a circumferential track 114 formed in the portion of its exterior surface that mates with the cover 104*a*. An O-ring 116 is disposed within the track 114 to provide a fluid seal between the end bell 102*a* and cover 104*a*.

The central body 100 has a cylindrical opening formed centrally through it along its longitudinal axis. A substantially hollow, cylindrical sleeve 70 is disposed within the cylindrical opening. The sleeve 70 may be formed of stainless steel or other suitable material.

The sleeve 70 has a spill inlet opening 72 formed in its lower surface. A plurality of circumferentially spaced apertures at the left end in the figure define a spill outlet opening 74. In the preferred embodiment there are four tracks of such circumferentially spaced apertures. Similarly, another like plurality of circumferentially spaced apertures at the right end in the figure, define another spill outlet opening 76. Both of the spill outlet openings 74 and 76 are formed within the span of a pair of recesses 122 and 124 in the outer diameter of the sleeve 70. The recesses 122 and 124 provide fluid communication between the spill outlet openings 74 and 76 and a fluid chamber 126 defined by the interstices within the internal volume of the valve 40.

A common channel 128 communicates the fluid chambers 126 at both ends of valve 40 with a spill outlet port 130. The spill outlet port 130, as will presently be described in detail, communicates directly with drain.

The spill inlet opening 72 in the sleeve 70 is in communication with a spill inlet port 132 formed in the central body 100. The spill inlet port 132 terminates at its outer end in a threaded, tapered bore of relatively increased diameter. A bushing 136 has one end in threaded engagement with the bore. The other end of the bushing 136 is received within a female fitting 138. The fitting 138 couples a spill line 140 to the bushing 136.

The spill outlet port 130 has tapered threads at its upper end to receive one end of a bushing 144. The other end of the bushing is in threaded engagement with a female fitting 146. The female fitting 146 couples a drain line 148 to the bushing 144.

A stop 150 in the form of a slotted-head bolt is coupled directly to the central body 100 above the end bell 102*a*. The purpose of the stop 150 will be made more apparent in conjunction with the description of FIG. 5.

A stator assembly 82, of like construction to the stator assembly 82 of FIG. 3, is mounted within the end bell 102*a*. The stator assembly 82 is secured at its upper and lower ends to a respective pair of retaining flanges 152*a* and *b*. A fastener, as exemplified by bolt 154, secures the stator assembly 82 to the flange 152*b*.

A rotatable armature 84 is centrally disposed within the stator assembly 82. The rotational movement of the armature 84 is controlled by four solenoids mounted on the stator assembly 82, of which two solenoids 90 and 96 are illustrated in FIG. 4. The full complement of solenoids will be more fully detailed in FIGS. 5 and 6 to be hereinafter described.

The cylindrical sleeve 70 has disposed within it a valve closure element, generally indicated at 50. The valve closure element 50 includes a central section in the form of a spindle 52 that terminates at its opposite ends in integral, cylindrical segments 156*a* and *b*. As previously described, the spindle 52 is formed of elastically deformable material with sufficient resilience or spring characteristic to permit it to undergo torsion through a range of angular displacement corresponding to the angular displacement required to open and close a spill path at either end of the cylindrical sleeve 70.

Each of the cylindrical end segments 156*a* and *b* is fitted into a respective end head 54 and 56 and rigidly secured therein, preferably by pinning. Each of the end heads 54 and 56 has a cylindrical opening through its internal end face to permit entry of a respective cylindrical end segment 156*a* and *b*.

Reference is now made to FIG. 7 which is an exploded perspective view which more fully illustrates the mechanical coupling of the end head 54 with the rotary solenoid relay 80.

The sleeve 70 is shown disposed within the central longitudinal opening in the central body 100. The common channel 128 is shown located above the sleeve 70 in a manner consistent with the illustration of FIG. 4.

The stator assembly 82 is shown in alignment with a portion of the retaining flange 152*a* to which it is secured. The stator assembly 82 and retaining flange 152*a* have formed in them pairs of complementary bores 158*a* and *a'* and 158*b* and *b'* for their assembly.

The valve closure element, generally indicated at 50, includes the spindle 52. The end head 54 is coupled to the spindle 52 in the manner previously indicated. The end head 54 has a plurality of circumferentially spaced apertures 78. In preferred form, there are four tracks of apertures 78 which have equal longitudinal spacing with the apertures defining the spill outlet openings 74 in the sleeve 70, as illustrated in FIG. 4.

A neck segment of reduced diameter divides the portion of the head 54 having the apertures 78 from a flanged portion 162 that is adapted to couple to the rotatable armature 84. The flanged portion 162 comprises a set of symmetrical tangs 164*a, b, c* and *d* which extend through a washer 166 onto the rotatable armature 84.

A number of fastening elements are used exteriorly of the rotatable armature 84 to secure the coupling of the flanged portion 162 of the head 54 with the rotatable armature 84. The fastener elements include a thrust washer 168, a shim 170, and an expansible ring clip 172 that seats in a circumferential track 174 near the outer end of the flanged portion 162.

Referring again to FIG. 4, the coupling of the end head 54 with the rotatable armature 84 can be seen as it was illustrated and described in connection with FIG. 7. Specifically, the tangs 164*a* and *b* can be seen to extend through the stator assembly 82 in engagement with a rotatable armature 84. The washer 166 is disposed on the inside of the stator assembly. The thrust washer 168, shim 170 and expansible ring 172 are mounted on the tang 164 on the outside of the stator assembly 82.

Reference is now made to FIG. 5 which is an end view of the actual embodiment of the spill valve 40. The spill valve 40 is shown with the end cover 104*a* removed for clarity of illustration.

The end bell 102*a* is fastened to the central body 100 by a plurality of Allen head bolts 180*a, b, c* and *d* distributed about the periphery of the end bell 102*a*. Each of the bolts 180*a, b, c* and *d* is inserted through a respective guide slot 182*a, b, c* and *d* in the periphery of the end bell 102*a*.

The end bell 102*a* converges along lines 184*a* and *b* at its upper boundary toward a reduced diameter at its top center position 186. A pair of integral, upright positioning flanges 188*a* and *b* are spaced in symmetric relation on either side of top center point 186. Each of the positioning flanges 188*a* and *b* has a threaded cross bore formed therethrough. A pair of set screws 190*a* and *b* are in threaded engagement in the cross bores of the respective positioning flanges 188*a* and *b*. The inward end of each of the set screws 190*a* and *b* bear against the stop 150 which was earlier referred to in description of FIG. 4. The provision of set screws 190*a* and *b* in the positioning flanges 188*a* and *b* represent a means for calibrating the relative angular position of the end bell 102*a* on the central body 100.

The end bell 102*a* has a first mating surface 192 and second concentric mating surface 194 which bound the circumferential track 114. The circumferential track 114 is adapted to seat an O-ring or similar type gasket to provide a fluid seal between the end bell 102*a* and cover (104*a*, not shown in the present view) in the manner indicated in FIG. 4. The cover 104*a* is fastened to the end bell 102*a* with fasteners that are received in a plurality of symmetrically disposed threaded bores 196*a, b, c* and *d* formed in the inner face of the end bell 102*a*.

The stator assembly 82 is secured to the retaining flanges (52*a* and *b*, now shown in the present view) of end bell 102*a* by a plurality of symmetrically disposed bolts 198*a, b, c* and *d*. The respective threaded bores in the stator assembly 82 that receive the bolts 198*a* and *d* were illustrated in aligned relation in FIG. 7 as 158*a, a', b* and *b'*.

The stator assembly 82 supports a set of solenoid coils 90, 92, 94 and 96. The coils 90 and 92 are used to actuate the rotatable armature 84 that is centrally mounted in the stator assembly 82. The solenoid coils 94 and 96 are used to damp the motion of the rotatable armature 84 to provide controlled acceleration and deceleration characteristics. The solenoid coils 94 and 96 are not strictly essential for operation of the present invention and need be selected only if a damping capability is desired.

Another like set of solenoid coils is mounted within the other end bell 102*b* shown in FIG. 4. The description of the solenoid coils 90, 92, 94 and 96 of FIG. 5 is directly applicable to their counterpart solenoid coils at the other end of the spill valve 40.

The solenoid coils 90, 92, 94 and 96 are energized by signals from an external source supplied through terminals, such as terminal 202 which is mounted in a bore in the wall of the end bell 102*a*.

Figure 11:
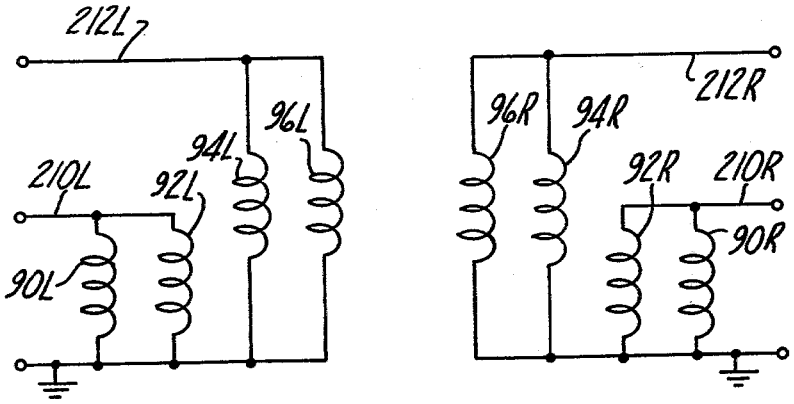
FIG. 11 is a schematic view of the electrical interconnection of the solenoid coils used in the rotary solenoid-actuated relays from the spill valve of FIGS. 4 and 5.

Reference is now made to FIG. 11, which is a schematic view of the electrical connection of the solenoid coils. The solenoid coils at the left end of the spill valve 40 as illustrated in FIGS. 4 and 5 are identified as 90L, 92L, 94L and 96L, and the solenoid coils at the right end of the spill valve are identified as 90R, 92R, 94R, and 96R. For both the left and right end set of soilenoid coils, the coils 90 and 92 represent the actuating coils, i.e. these coils provide primary control over the actuation of the rotatable armature. Accordingly, the solenoid coils 90 and 92 are connected in parallel and receive equally an actuating signal on line 210.

In both the left and right set of solenoid coils, the coils 94 and 96 are used to damp the motion of the rotatable armature. Accordingly, these coils are connected in parallel and both receive a damping signal on line 212. All of the coils in both the left and right sets have one terminal connected to ground.

Referring again to FIG. 5, the coupling of the integral tangs 164*a, b, c* and *d* with the rotatable armature 84 can be seen from an end view. For clarity of illustration the external fastening elements, including thrust washer 168, shim 170 and expansible ring 172, have been removed. Only the washer 166 is apparent behind the rotatable armature 84.

The manner in which the external fastening elements are coupled to the integral tangs 164*a, b, c* and *d* is most clearly seen in the enlarged end view of FIG. 6. The rotatable armature 84 is shown centrally mounted within the stator assembly 82. A plurality of bobbins 204, 206, 208 and 210 are shown in part mounted on the central vertical member of the stator assembly 82. The assembly of fastening elements is locked in place by the seating of the expansible ring clip 172 in the circumferential groove 174 in the outer surface of the tangs 164*a, b, c* and *d*. The shim 170 is positioned adjacent and behind the expansible ring clip 172. The thrust washer 168 is adjacent and behind the shim 170, although not apparent in this view.

Referring again to FIG. 5, the external connections to the central body 100 are shown in detail. More specifically, at the lower end of the central body 100 the bushing 136 has one end in threaded engagement with the spill inlet port in the body in the manner previously described. The other end of the bushing 136 is in threaded engagement with the female fitting 138. The female fitting couples a fluid line 140 with the bushing 136. The other end of the fluid line 140 communicates with a standard banjo fitting 200. The banjo fitting 200 is adapted to couple with a male fitting on the end of a line communicating a pump chamber with spill valve 40.

At the upper end of the central body 100 is the bushing 144 which has one end in threaded engagement with the spill outlet port in the manner previously described, and the other end coupled to a line (not shown) communicating the spill valve 40 to drain.

Figure 9:
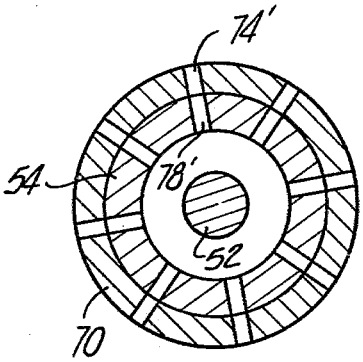
FIG. 9 is a cross-sectional view taken along 8—8 of FIG. 4 showing the one end of the valve closure element in an open condition.
Figure 8:
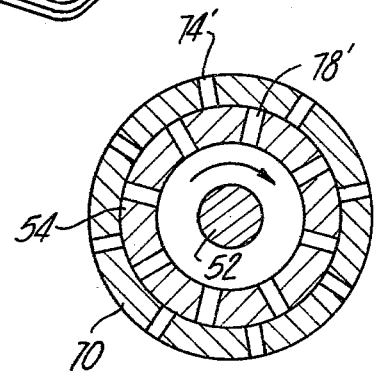
FIG. 8 is a cross-sectional view taken along line 8—8 of FIG. 4 that shows one end of the valve closure element in closed condition.

The operation of the spill valve 40 can be understood through the illustrations of FIGS. 8 and 9, and with the aid of the preceding description of the three basic operating positions of the spill valve 40 given in connection with FIG. 2. FIGS. 8 and 9 are cross-sectional views taken along line 8—8 of FIG. 4.

FIG. 8 shows the concentric arrangement of the spindle 52, end head 54 and sleeve 70. The end head 54 has an equally spaced, circumferential distribution of apertures 78, with the aperture of aperture 78' being used for the ensuing description. The sleeve 70 has a like number of equally spaced, circumferentially distributed apertures 74, with 74' being used for the ensuing description.

In FIG. 8 the spindle 52 and end head 54 are shown rotated in the direction indicated by the curvilinear arrow through an angular displacement that takes the aperture 78' and aperture 74' out of registry. In this position, spilling through the aperture 74' is prevented.

FIG. 9 illustrates the same concentric arrangement of members as FIG. 8. However, in the illustration of FIG. 9, the spindle 52 and end head 54 are angularly displaced relative to their position in FIG. 8 to bring the apertures 78' and 74' into registry. In this position, the valve is open and spilling occurs.

The spill valve 40 of FIGS. 4–7 can be made to operate through the cycles shown in FIG. 2. In the reset position, the solenoids 90 and 92 at the left end of the valve will be actuated and all of the solenoids at the right end of the valve will be released. This will cause the head 54 to rotate through a predetermined angular interval that closes fluid communication between the apertures 78 in the head and the spill outlet opening 74 in the sleeve 70, and bring into registry the aperture 78 in the head 56 with the spill outlet opening 76 at the other end of the sleeve. Accordingly, in the reset position the valve will be open and spilling will occur. The reset position is an unstressed or a low energy position.

In the stroked position, the solenoids 90 and 92 at the left end of the valve 40 will remain actuated while the corresponding pair of solenoids at the right end of the valve will undergo actuation. The actuation of the corresponding right pair of solenoids will take the apertures 78 in the head 56 out of registry with the spill outlet opening 76 in the right end of the sleeve. In the stroked position the spill valve 40 is closed and spilling is interrupted. This, of course, permits injection of fuel to a distributor. The stroked position is a high energy or stressed condition that requires the spindle 52 to undergo torsion.

In the released position, the solenoid coils 90 and 92 at the left end of the spill valve 40 are released while the corresponding pair of solenoid coils at the right end of the spill valve are kept actuated. The release of the solenoids 90 and 92 causes the apertures 78 in the end head 54 to come into registry with the spill outlet opening 74 in the left end of the sleeve 70. In the released position spilling again occurs. The released position is an unstressed or low energy condition.

The transition from the stroked position to the released position is accelerated by the release of potential energy stored in the spindle 52. The potential energy is stored in the spindle 52 as a result of the torsion applied to the spindle when brought into the stroked position. This acceleration in the transition from the stroked position to the released position marks a rapid cutoff of the fuel injection interval. This can be used to an advantage to precisely limit the injection interval, and thereby provide precision metering of fuel.

Figure 10:
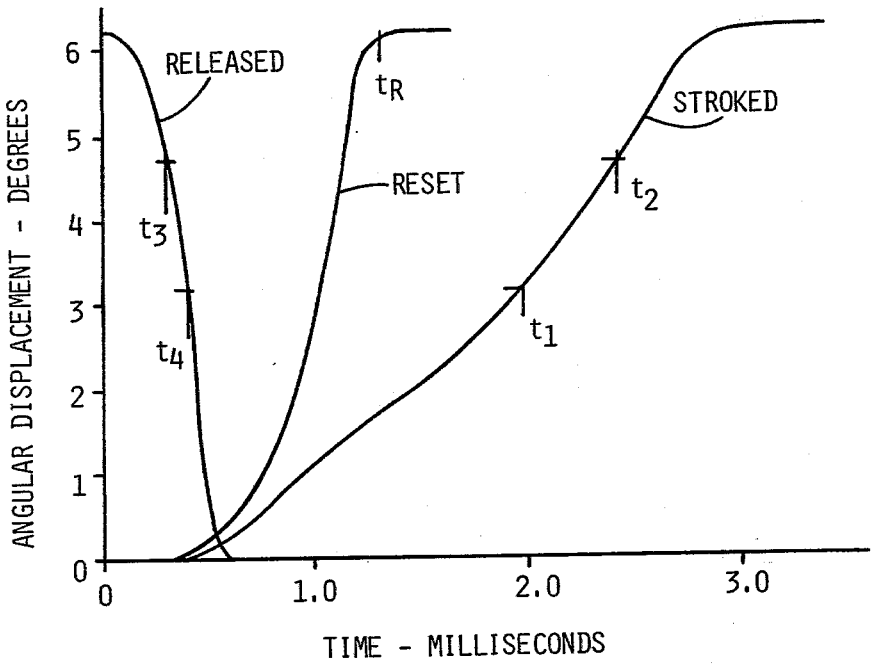
FIG. 10 is a representative graph of time versus angular displacement of the valve closure element for its transitions between the three basic positions illustrated in FIG. 2.

FIG. 10 is a graph of time (in milliseconds) versus angular displacement (in degrees) for the time intervals required for transition between the three basic positions of the valve closure element 50 of the spill valve 40. The information represented by this graph was derived from computations based on a mathematical model of one form of the present spill valve. It is assumed to require a six-degree displacement to move each of the end heads 54 and 56 between registry and nonregistry with corresponding spill outlet openings 74 and 76 in the sleeve 70.

To change from the release position to the reset position requires approximately 1.2 milliseconds. This is shown by the curve labeled RESET. To accomplish this transition, the solenoid coils 90 and 92 at the left end of the valve 40 are actuated while the corresponding pair of solenoid coils at the right end of the valve are not actuated.

The transition from the reset position to the stroke position takes approximately 2.5 milliseconds. This is shown by the curve labeled STROKED. To accomplish this transition, the solenoid coils 90 and 92 at the left end of the valve 40 are maintained actuated, and the corresponding pair of solenoid coils at the right end of the valve undergo actuation. This is the relatively slowest transition due to the fact that during the stroke cycle the spindle is undergoing torsion and has a spring-like resistance to rotation of the right end head 56. However, this relatively slow transition time is used to an advantage in providing a relatively gradual slope to the leading edge of a pressurized fuel charge. The time $t_1$ marks the beginning of the stroked position when the valve 40 begins to close, and the time $t_2$ marks the completion of the transition from the reset to the stroked position when the valve is fully closed.

The transition from the stroked position to the release position takes approximately 0.4 millisecond. This is shown by the curve labeled RELEASED. To accomplish this transition, the solenoid coils 90 and 92 at the left end of the valve 40 are released. This release is accompanied by a release of potential energy stored in the spindle 52 which makes the transition from the stroked position to the released position the most rapid of the previously described transitions. At time $t_3$ the spill valve 40 is just beginning to open, and at time $t_4$ the spill valve becomes fully opened.

The invention has been described in an illustrative manner, and it is to be understood that the terminology which has been used is intended to be in the nature of words of description rather than of limitation.

Many modifications and variations are possible in light of the above teachings. It is, therefore, to be understood that within the scope of the appended claims the invention may be practiced otherwise than as specifically described.

The embodiments of the invention in which an exclusive property or privilege is claimed are defined as follows:

1. In a distributor-type fuel injection system of the class wherein fuel from a source is supplied under pressure from the chamber of a pump to a distributor which cyclically and separately communicates each of a plurality of injector feed lines with the pump chamber, the improvement comprising:

a spill valve for controlling fuel injection for each injector valve during the time at which its respective feed line is in communication with the pump chamber including;

a valve body having a spill inlet port in communication with the pump chamber and a spill outlet port in communication with the fuel source;

a spill conduit, formed within the valve body, having first and second spill paths therethrough to communicate the inlet port to the outlet port;

first valve means, disposed within the valve body and actuatable between an open condition and a closed condition to control the flow condition of the first spill path;

second valve means, disposed within the valve body and actuatable between an open condition and a closed condition to control the flow condition of the second spill path; and valve connector means, interconnecting the first valve means and the second valve means, and responsive to a closure of the first and second flow paths to store potential energy and an opening of a flow path to release such potential energy.

2. The improvement as defined in claim 1, wherein the valve connector means has a spring characteristic, and is in a high energy state when the first and second valve means are in their closed condition, and in a low energy state when either of the valve means is in an open condition.

3. The improvement as defined in claim 2, wherein the valve connector means is rotatable within the spill conduit and experiences torsion when the first and second valve means are in their closed condition.

4. The improvement as defined in claim 3, wherein the valve connector means includes an elongate member which is elastically deformable through a range of angular positions corresponding to an actuation of one of the valve means between its open condition and closed condition.

5. The improvement as defined in claim 4, wherein the elongate member has a spindle-like shape.

6. The improvement as defined in claim 4, wherein the elongate member is formed of stainless steel.

7. The improvement as defined in claim 1, wherein, the spill conduit has formed in it an inlet opening, a first outlet opening, and a second outlet opening, spaced from the first outlet opening, thereby defining the first and second spill paths therethrough, the first valve means includes a movable member disposed within the spill conduit adjacent the first outlet opening, the movable member having an aperture formed therein, which, when in registry with the first outlet opening, opens the first spill path and when in non-registry closes the first spill path, and the second valve means includes a movable member disposed within the spill conduit adjacent the second outlet opening, the movable member having an aperture formed therein, which, when in registry with the second outlet opening, opens the second spill path and when in non-registry closes the second spill path.

8. The improvement as defined in claim 7, wherein the movable members are interconnected by the valve connector means.

9. The improvement as defined in claim 7, wherein each of the valve means further includes actuating means for actuating the movable member between the open valve condition and the closed valve condition.

10. The improvement as defined in claim 9, wherein each of the actuating means comprises a solenoid relay having an armature connected to the movable member.

11. The improvement as defined in claim 10, wherein each of the movable members is rotatable within the spill conduit, and each actuating means comprises a rotary solenoid relay having a rotatable armature.

12. The improvement as defined in claim 11, wherein each of the movable members has flange means formed thereon for connecting to a rotatable armature.

13. The improvement as defined in claim 11, wherein each rotatable relay comprises first and second complementary coil windings having a common magnetic flux path through the rotatable armature for actuating the rotatable armature in response to a control signal.

14. The improvement as defined in claim 13, wherein each rotary solenoid relay comprises third and fourth complementary coil windings having a common magnetic flux path for damping actuation of the rotatable armature in response to a damping signal.

15. The improvement as defined in claim 7, wherein the valve body has formed within it a common channel communicating the first and second outlet openings of the spill conduit with the spill outlet port.

16. A spill valve for use in a fluid control system wherein pressurized fluid is intermittently spilled to a low pressure drain to control its flow through a flow path, the spill valve comprising:

a valve body having a spill inlet port for receiving the pressurized fluid and a spill outlet port for discharge of spilled fluid;

a spill conduit, disposed within the valve body, having first and second spill paths formed therethrough to communicate the inlet port and the outlet port;

valve closure means, disposed within the spill conduit for rotational motion therein, and being actuable into a first, low-energy condition when one of the spill paths is open to permit spilling, and into a second, high-energy condition when the spill paths are closed to permit flow through the flow path wherein the valve closure means has a spring characteristic, and is stressed when the first spill path and the second spill path are closed, and unstressed when either of the spill paths is open; and actuator means, connected to the valve closure means and responsive to a control signal, for actuating the valve closure means between the first condition and the second condition in accordance with the control signal.

17. The spill valve as defined in claim 16, wherein the valve closure means experiences torsion when the first spill path and the second spill path are closed.

18. The spill valve as defined in claim 17, wherein the valve closure means includes an elongate member which is elastically deformable through a range of angular positions corresponding to the range of positions between the opening and closing of a spill path.

19. The spill valve as defined in claim 18, wherein the elongate member has a spindle-like shape.

20. The spill valve as defined in claim 18, wherein the elongate member is formed of stainless steel.

21. The spill valve as defined in claim 16 wherein, the spill conduit has formed in it an inlet opening, a first outlet opening, and a second outlet opening, spaced from the first outlet opening, thereby defining the first and second spill paths therethrough; and the valve closure element comprises a central section having a movable end section attached to each of its opposed ends, each of the end sections being disposed adjacent an outlet opening and having an aperture formed therein which when in registry with an adjacent outlet opening opens the respective spill path, and when in non-registry closes the respective spill path.

22. The spill valve as defined in claim 21, wherein the central section has a torsional spring characteristic and is stressed when the aperture of each end section is in non-registry with an adjacent outlet opening, and unstressed when the aperture of either end section is in registry with an adjacent outlet opening.

23. The spill valve as defined in claim 16, wherein the valve closure means comprises an elongate member having a pair of opposed ends, and the actuator means comprises a pair of rotary solenoid relays connected to each end of the elongate member.

24. The spill valve as defined in claim 23, wherein each rotary solenoid relay includes a rotatable armature, and each end of the elongate member has flange means formed thereon to connect to the rotatable armature.

25. The spill valve as defined in claim 23, wherein each rotary solenoid relay includes a rotatable armature and first and second complementary coil windings having a common flux path through the rotatable armature for actuating the rotatable armature in response to a control signal.

26. The spill valve as defined in claim 25, wherein each rotary solenoid relay comprises third and fourth complementary coil windings having a common magnetic flux path for damping actuation of the rotatable armature in response to a damping signal.

* * * * *